United States Patent [19]

de los Santos Izquierdo

[11] 3,995,784

[45] Dec. 7, 1976

[54] ROTARY MILL FOR MICRONIC GRINDING

[75] Inventor: Federico de los Santos Izquierdo, Mexico City, Mexico

[73] Assignee: Consejo Nacional de Ciencia y Tecnologia, Mexico City, Mexico; a part interest

[22] Filed: Mar. 21, 1975

[21] Appl. No.: 560,892

[52] U.S. Cl. ..... 241/275; 241/79.1

[51] Int. Cl.[2] ..... B02C 13/09

[58] Field of Search ..... 241/40, 275, DIG. 10, 241/79.1

[56] References Cited

UNITED STATES PATENTS

| | | | |
|---|---|---|---|
| 2,487,088 | 11/1949 | Andrews | 241/40 |
| 2,645,345 | 7/1953 | Dodds | 241/275 X |
| 2,765,122 | 10/1956 | Trost | 241/40 |
| 2,992,784 | 7/1961 | Behnke et al. | 241/275 |
| 3,834,631 | 10/1974 | King | 241/275 X |
| 3,881,664 | 5/1975 | Bowling et al. | 241/DIG. 10 |

*Primary Examiner*—Granville Y. Custer, Jr.
*Assistant Examiner*—Howard N. Goldberg
*Attorney, Agent, or Firm*—Ladas, Parry, Von Gehr, Goldsmith & Deschamps

[57] ABSTRACT

A rotary mill for micronic grinding comprising an impelling mechanism for the solid materials to be ground, such as minerals and the like, consisting of a disc, the walls of which are perforated in such manner that the materials are discharged through the perforations, and flung against the peripheral wall of the mill, thus effecting the grinding. Both around the perforations in the disc and upon the peripheral wall a protective layer is formed of the material being ground, so that the grinding is effected by the impact of the material upon the material, thus forming a self-generated grinding process.

4 Claims, 4 Drawing Figures

ROTARY MILL FOR MICRONIC GRINDING

OBJECTS OF THE INVENTION

The object of the present invention is to increase the efficiency of rotary grinding mills, achieving micronic milling with the mill here described which operates in a simple manner, achieving the grinding of the materials upon themselves and at the same time achieving protection for the working parts of the mill, since the materials being ground protect the walls of the mill by depositing there, thus preventing wear.

Moreover, the present invention has the following advantages:

1. Light weight in relation to its performance.
2. Easy handling because of light weight.
3. Low cost because of simple design.
4. Little wear and maintenance, since the materials which are ground protect the sections or working area of the mill.
5. Self-grinding of the materials.

Before going on to describe the present invention in detail, it is desirable to emphasize that the drawings which accompany the description illustrate one embodiment of carrying out the present invention, but that the latter may be subject to variations and modifications as circumstances may dictate although always within the same principle of the invention herein described, with no restrictions other than those resulting from the Claims and the scope solicited.

DETAILED DESCRIPTION OF THE INVENTION

Figure 1:
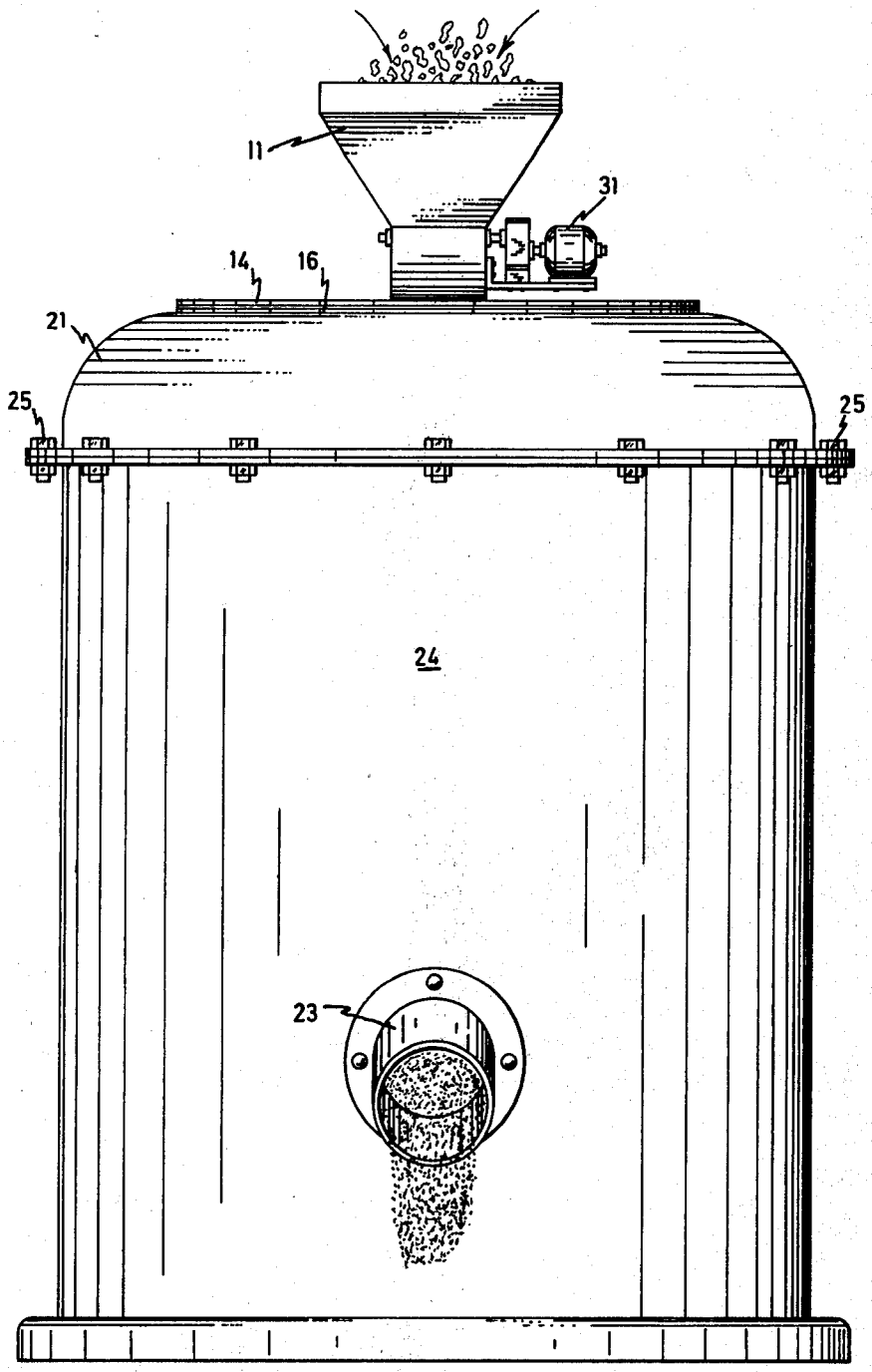
FIG. 1 is a front view of the mill.

The present invention is related to mills for grinding materials, and more particularly to a certain type of mill whose characteristics, differences and advantages are described below.

With reference to the drawings, the present invention consists of a mill comprising a cylindrical container 24 having an opening at its upper end. The opening is closed off by a bellmouthed tube 21. The tube 21 has a narrow portion 21A of uniform diameter, and flares outwardly at 21B. The portion 21C follows the portion 21B, and is secured to the upper end of the container 24 by bolts 25. The mill also comprises a rectangular hopper 11, which receives the material which is to be ground. Inside the hopper 11 is roll 12 with blades which thrust the material toward lower tube 13 as the arrows indicate.

When the material comes out of tube 13 it falls within the portion 21A of the tube 21 into the interior of the mill in its central part, as the arrows indicate.

The hopper 11 is fixed to a piece 14 in the shape of a disc, which has formed in its certain apertures 15.

Said apertures 15 coincide with the openings made in another lower disc 16 of the same form and size as disc 14. Said lower disc 16 is fixed to the tube 21, while the upper disc is movable and can revolve to open and close. Air inlets 15 into the inside of the mill with the object of regulating the expulsion of the ground materials by air lift.

The materials which enter the mill fall upon a disc 17 which revolves at high speed. Said disc has its edge just as is shown in section of FIG. 2.

Figure 2:
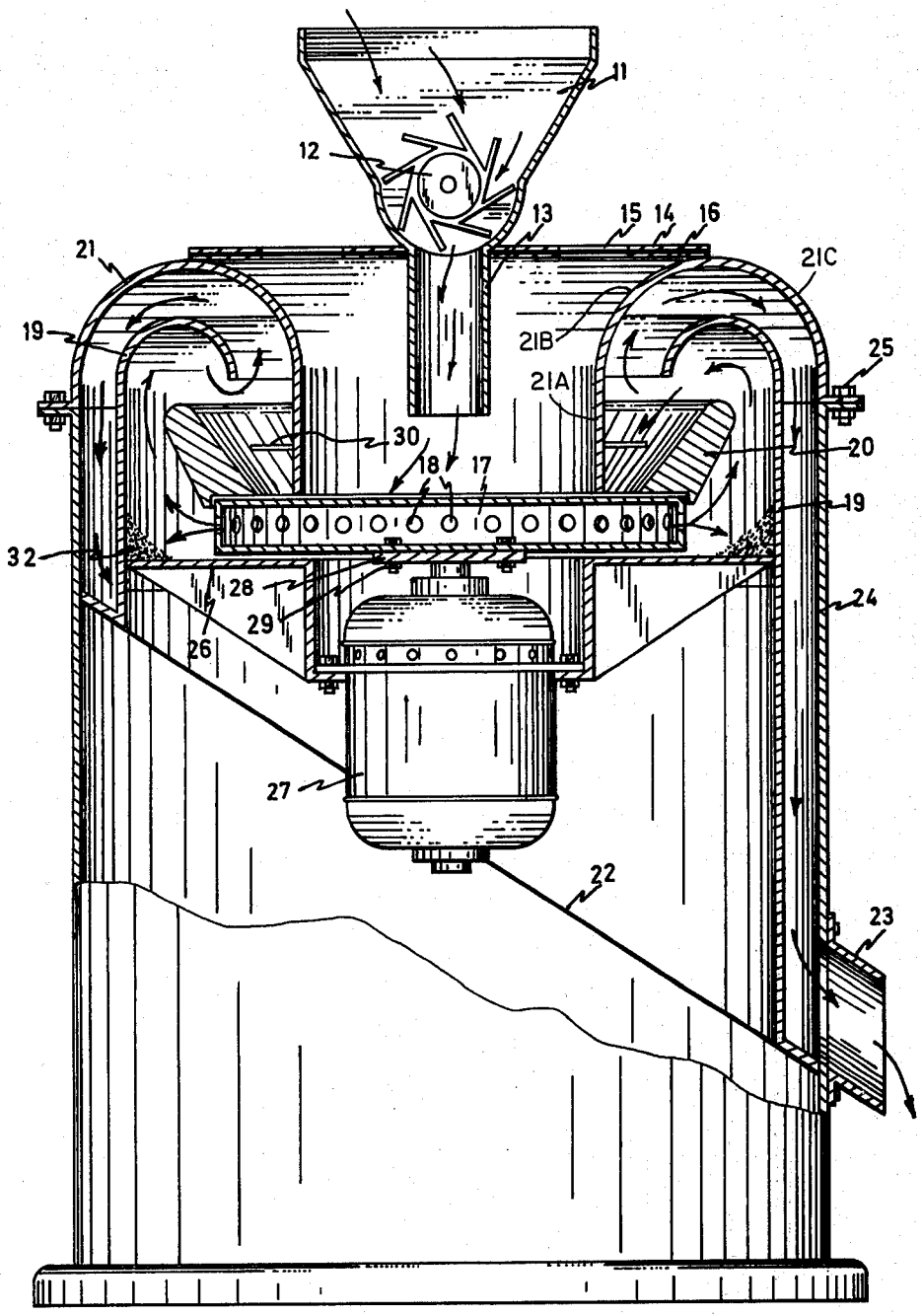
FIG. 2 is a view in section, showing the inner part of the mill.
Figure 3:
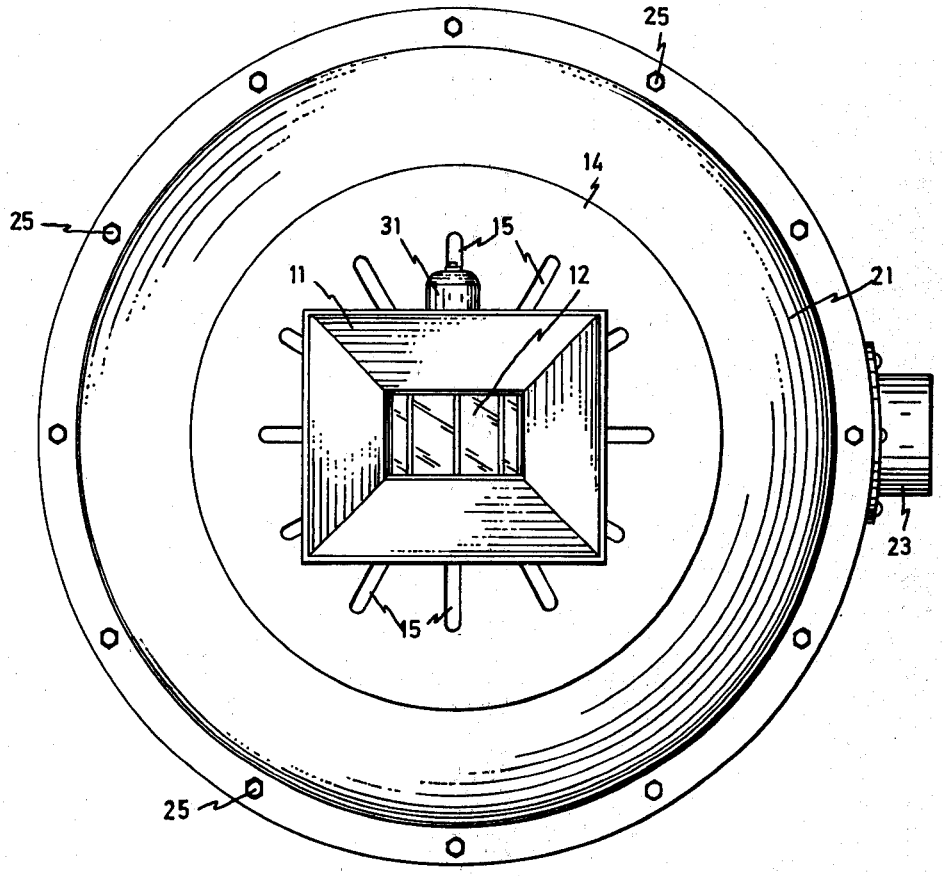
FIG. 3 is a plan view.
Figure 4:
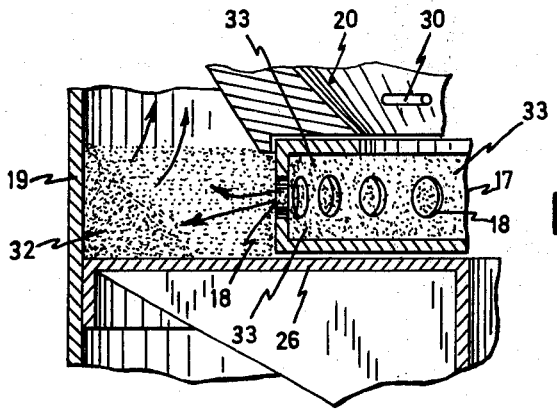
FIG. 4 is a detailed view of the disc with the peripheral wall of the mill.

The peripheral wall of disc 17 has formed therein certain holes or perforations 18, as indicated by the direction of the arrows in FIG. 2, and material passing therethrough strikes against piece 19 and accumulates upon a shelf 26, secured to the piece 19, to form a sloping bed or bank of material 32. Thus is formed protective cover 32 around piece 19, as is seen in detail in FIG. 4. At the same time a protective cover 33 of material is formed around holes 18.

Holes 18 induce a current of air which enters the tube 21 through openings 15 and goes out through perforations 18. Said current of air entrains the materials passing through the holes 18 in the direction indicated by the arrows, that is, toward the top of piece 19 between the piece 19 and the portion 21A of the tube 21 is a funnel shaped deflecting piece 20, and the upper end of the piece 19 is bent over towards the piece 20.

The finely-ground materials are driven by the upward current of air towards the top of piece 19, as the direction of the arrows indicates. The upper end of the piece 19 cooperates with the piece 20 so that larger, semi-ground material is deflected downwards by the piece 19 and is fed back into the disc 17 by the piece 20. The deflecting piece 20, which is fixed, has the dual objectives of protecting the upper portion of disc 17 and of directing the air current so that the particles will go in the proper direction. Thus, the inner wall of piece 21, serves as an air duct and entrance for materials moving toward rotary disc 17.

Finely-ground materials are thrown upward and are carried with the air stream, as the direction of the arrows indicates, and then in seeking the outlet fall into a chamber of circular annular shape the bottom of which is tilted, as is shown in the section of FIG. 2. This annular discharge hopper piece is marked number 22.

Discharge of the ground material takes place through piece 23.

Piece 24 is the base of the mill, serving as support for the entire mechanism.

Piece 26 is secured to piece 19. Said piece 26 serves as the support for motor 27, which in turn causes disc 17 to revolve. The motor is joined to the disc by means of piece 28 and bolts 29.

Piece 20 is joined to piece 21 by means of radial pins 30.

Piece 12 is turned by means of motor 31 shown in FIG. 1.

Grinding of the materials is effected in the following manner:

The material deposited in hopper 11 drops down as driven by blade valve 12, driven by motor 31. This valve and motor mechanism regulates the entry of material to be ground.

Said material is received by rotary disc 17, which by centrifugal force flings it at high speed through holes 18, causing it to follow a certain trajectory.

Part of the incoming material protects the inside wall of holes 18, preventing wear. The rest of the material is projected through said holes 18, striking against a bank 32 which is formed of the same material being ground. See detail of FIG. 4.

The impact of the material upon itself determines the conminution; and this process is repeated continuously.

The finely-ground materials pass out through outlet duct 23 of the mill. The materials which have not reached the degree of fineness required go back into impeller disc 17 and continue being ground until the desired result is obtained.

The degree of fineness of grinding is determined by the quantity of air which enters the mill, since a larger quantity of air will mean a more powerful sweep upon the material and hence less fineness in the grinding performed; conversely, a reduced flow of air will mean finer grinding, since the material will have a longer residence time while being ground in the mill.

This mill thus performs a self-grinding operation by causing the grinding contact to be made within the feed material itself, and at the same time sets up a protective layer to prevent wear upon the working parts of said machine.

I claim:

1. A rotary mill comprising a container having an open end; a tubular piece having an end bellmouthed, which bellmouthed end is coupled to the open end of the container; air inlet means coupled to the bellmouthed end of the tubular piece; a hopper coupled to the air inlet means for feeding material into the tubular piece, said hopper including a regulating feed valve; a revolving disc located in that end of the tubular piece opposite to its bellmouthed end; a funnel shaped deflecting piece located around said tubular piece and having one end registering with the revolving disc for feeding semi-ground material thereto; wall means surrounding the revolving disc and the deflecting piece and having one end projected and bent towards the deflecting piece, against which wall means the materials flung from the revolving disc will strike; a circular plate registering with the revolving disc and joined to the wall means, so that material flung from the revolving disc forms a bank in the region of the joint and which circular plate together with the wall means form a first receiving chamber for material not yet fully ground; a first passage defined by the bent projection and the deflecting piece for the semi-ground material be returned to the revolving disc; a second passage defined by the bent projection and the bellmouthed end of the tubular piece for passing the finely-ground material; a second receiving chamber defined by the wall means and the container to house the finely-ground material from the second passage; and outlet means for the finely-ground material obtained from the second receiving chamber.

2. The rotary mill of claim 1, wherein the air inlet means comprises a pair of fan shaped discs one of which is fixed to said bellmouthed end and the other is rotatory and is registering with said fixed disc.

3. The rotary mill of claim 1, wherein said revolving disc includes perforations all around its periphery, through which perforations the materials to be ground are discharged against the wall means.

4. The rotary mill of claim 1, werein said second receiving chamber has a tilted bottom.

* * * * *